US006729058B2

(12) United States Patent
Ferguson

(10) Patent No.: US 6,729,058 B2
(45) Date of Patent: May 4, 2004

(54) APPAREL MOUNTED PICTURE SECURING AND DISPLAYING APPARATUS

(76) Inventor: Alfred Ferguson, 5958 Willard Dr., Apt. G, Hanahan, SC (US) 29406

( * ) Notice: Subject to any disclaimer, the term of this patent is extended or adjusted under 35 U.S.C. 154(b) by 350 days.

(21) Appl. No.: 09/792,574

(22) Filed: Feb. 23, 2001

(65) Prior Publication Data

US 2002/0116851 A1 Aug. 29, 2002

(51) Int. Cl.[7] ..... G09F 23/00; A43B 23/24

(52) U.S. Cl. ..... 40/636; 40/772; 2/245

(58) Field of Search ..... 40/329, 589, 636, 40/594, 661, 661.04, 771, 772, 781; 2/245; 36/136

(56) References Cited

U.S. PATENT DOCUMENTS 3,707,053 A * 12/1972 Itano ..... 40/781
4,254,566 A * 3/1981 Haskell ..... 40/636
4,310,976 A * 1/1982 Wilten ..... 40/661 X
D281,116 S 10/1985 Gamm
4,924,613 A * 5/1990 Levin ..... 40/586
5,081,717 A 1/1992 Shedd et al.
5,209,000 A * 5/1993 Rowland et al. ..... 36/136
5,359,733 A 11/1994 Brannon et al.
5,682,615 A 11/1997 Wahl et al.
5,727,766 A * 3/1998 Mayo ..... 40/772 X
5,740,557 A * 4/1998 Reid et al. ..... 40/329 X
D396,945 S 8/1998 Glass
5,800,900 A * 9/1998 Mitchell ..... 40/636 X
D401,394 S 11/1998 Herndon
D403,850 S 1/1999 Herndon
D404,770 S * 1/1999 Meade et al. ..... D20/24
5,881,391 A 3/1999 Mullaney ..... 40/329 X
6,128,801 A * 10/2000 Adzick et al. ..... 36/136 X
6,434,870 B1 * 8/2002 Fanjoy ..... 40/636

* cited by examiner

*Primary Examiner*—Brian K. Green
(74) *Attorney, Agent, or Firm*—John D. Gugliotta

(57) ABSTRACT

An apparel mounted picture securing and displaying apparatus is provided having a lower support member with a corner attachment orifice formed at each corner point. An upper frame element forming a transparent retention means within an outer perimeter is attached to the lower support member.

6 Claims, 3 Drawing Sheets

APPAREL MOUNTED PICTURE SECURING AND DISPLAYING APPARATUS

RELATED APPLICATIONS

The present invention was first described in Disclosure Document Registration 480,417 filed on Sep. 28, 2000 under 35 U.S.C. §122 and 37 C.F.R. §1.14. There are no previously filed, nor currently any co-pending applications, anywhere in the world.

BACKGROUND OF THE INVENTION

1. Field of the Invention

The present invention relates generally to apparel and head coverings combined with diverse articles and the like and, more particularly, to a picture holding frame element designed to be laced within a shoe upper.

2. Description of the Related Art

Modern fashion trends dictate an ever evolving and changing of popularity wherein the clothing, jewelry and accessories that are considered cutting edge today are considered passe tomorrow. In keeping with these trends, society's strong desire to be different and its willingness to be judged by the fashions that one wears, the industry is in a constant search for new and innovative styles that will help to define the next fashion trend. Not limited strictly to clothing, this need for innovation extends to all areas of fashion, including that of accessories, such as cosmetic jewelry and similar novelty items.

A search of the prior art did not disclose any patents that read directly on the claims of the instant invention; however, the following references were considered related.

The following patents disclose a decorative hat with a sporting display.

U.S. Pat. No. 5,881,391 issued in the name of Mullaney

U.S. Pat. No. 5,682,615 issued in the name of Wahl et al.

The following patents describe the ornamental design for a denim boot upper with a side pocket.

U.S. Pat. No. D 403,850 issued in the name of Herndon

U.S. Pat. No. D 401,394 issued in the name of Herndon

U.S. Pat. No. 5,359,733 issued in the name of Brannon et al. discloses patch attachments for a baseball-style cap.

U.S. Pat. No. 5,081,717 issued in the name of Shedd et al describes a headgear attachment for displaying advertising or the like.

U.S. Pat. No. D 396,945 issued in the name of Glass discloses the ornamental design for a cap bill and insert.

U.S. Pat. No. D 281,116 issued in the name of Gamm describes a pocketed athletic shoe upper.

Consequently, there is a constant need for new and innovative ideas that not only create new fashion styles, but also that innovates the fashion industry.

SUMMARY OF THE INVENTION

It is therefore an object of the present invention to provide fashionably novel apparel combined with diverse articles.

It is a feature of the present invention to provide an improved to a picture holding frame element designed to be laced within a shoe upper.

Briefly described according to one embodiment of the present invention, an apparel mounted picture securing and displaying apparatus includes a small plastic picture frame that is provided with a hook and loop fastening system. The frame itself is of a conventional nature and is sized to allow the placement of a small picture of an approximate size 1" by 1". Located on the back of the frame is the hook portion of a hook and loop fastening system such as Velcro®. The mating loop portion would be attached via adhesive or sewing thread to various articles of clothing such as a cap or a shoe. Thus, when installed upon the article of clothing, the invention can flex slightly with movement without danger of becoming dislodged.

The use of the present invention allows users to proudly show pictures of loved ones or other objects in a manner which is not only quick, easy and effective, but unique as well.

An advantage of the present invention is that it allows for the display of small pictures in a manner that attaches to articles of clothing such as caps, shoes and jackets.

Another advantage of the present invention is that its use presents a unique fashion statement.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
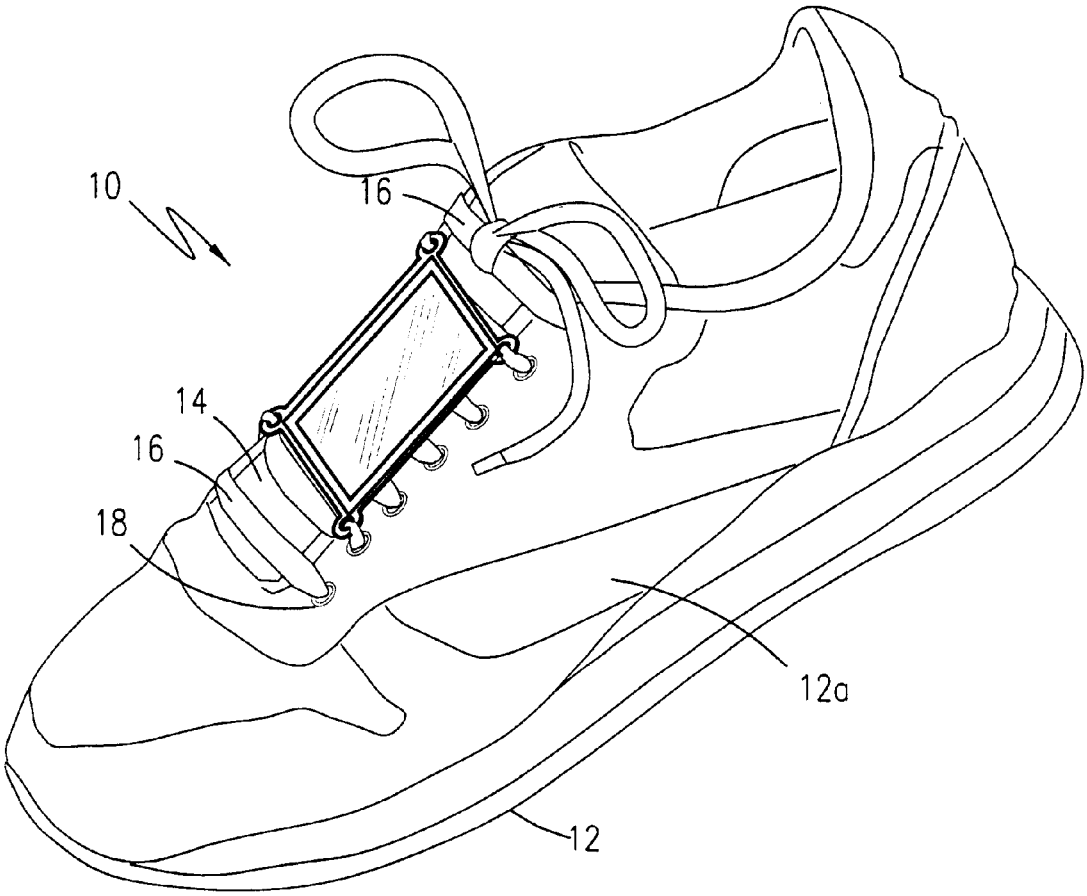
FIG. 1 is a perspective view of an apparel mounted picture securing and displaying apparatus according to the preferred embodiment of the present invention.
Figure 2:
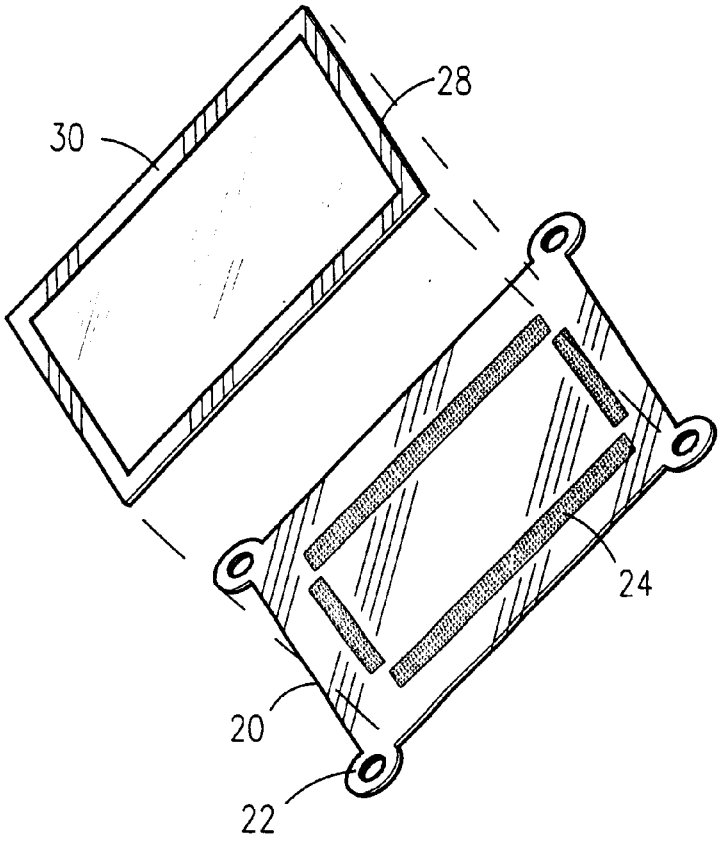
FIG. 2 is an exploded perspective view thereof.
Figure 3:
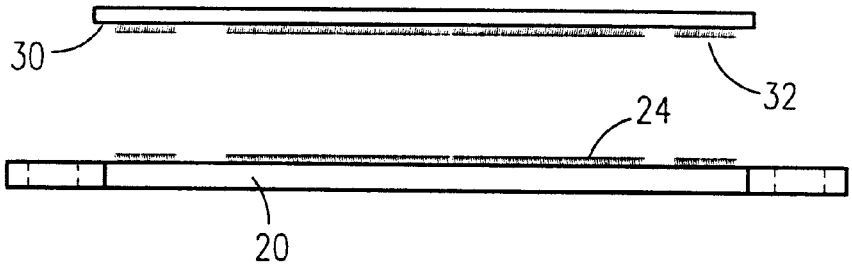
FIG. 3 is an exploded side elevational view thereof.

Referring now to FIGS. 1–3, an apparel mounted picture securing and displaying apparatus 10 is shown according to the preferred embodiment of the present invention. Shown herein, the display apparatus 10 is secured to an article of apparel, herein depicted as an otherwise conventional shoe 12. The shoe 12 has as split shoe upper 12*a* having a tongue 14 covering the shoe upper slit. As is conventionally known, a shoe lace 16 is threaded through a series of aligned eyelet orifices 18 in a manner crisscrossing the tongue 14. A lower support member 20 is formed of a generally planar surface having a rectangular outer perimeter and having a pair of lateral sides intersecting a pair of horizontal sides at four corner points. A corner attachment orifice 22 is mounted at each corner point.

It is envisioned in this embodiment of the invention that the corner attachment orifices 22 would allow for passage of the shoe lace 16 in such a manner as to allow the lower support member 20 to be laced onto the shoe in a manner covering the tongue 14 of the shoe 12.

In greater detail, the lower support member 20 has an upper surface that supports a plurality of loop fastener elements 24 of a hook and loop fastener. As shown, strips of loop fastener element 24 are affixed to the upper surface in a manner that circumscribes the outer perimeter of the lower support member. An upper frame element 26 is provided of a similar size and shape, and has a transparent retention means 28 of a rectangular shape formed within an outer perimeter. A non-transparent border 30 circumscribes the outer perimeter of the transparent retention means 28. On a lower surface 30 of the border 30 are hook fastener elements 32 of a hook and loop fastener. As shown, the hook fastener elements 32 align with the loop fastener elements 24 such as to allow the transparent retention means 28 to be aligned with and affixed to the lower support member 20 such as to form a display housing for holding, retaining, and displaying visual images through the transparent retention means 28. Thus, when installed upon the article of clothing, the invention can flex slightly with movement without danger of becoming dislodged.

Figure 4:
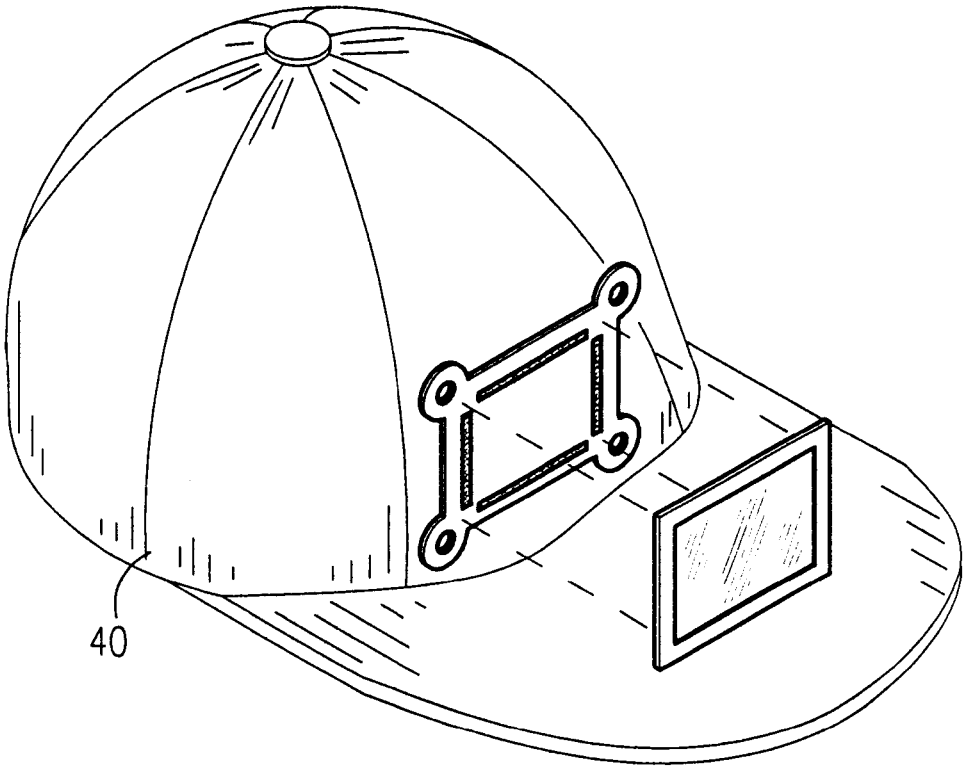
FIG. 4 is a partial exploded perspective view of an apparel mounted picture securing and displaying apparatus according to a first alternate embodiment of the present invention.

Referring to FIG. 4, apparel mounted picture securing and displaying apparatus 10 is shown affixed to a piece of headwear 40, shown herein as a conventional sports hat. In this configuration, the lower support member 20 is formed of a generally planar surface having a rectangular outer perimeter and having a pair of lateral sides intersecting a pair of horizontal sides at four corner points. A corner attachment orifice 22 is mounted at each corner point to the front surface of the hat 40. The transparent retention means 28 can then be affixed thereto in a similar manner for forming a display housing for holding, retaining, and displaying visual images through the transparent retention means 28.

2. Operation of the Preferred Embodiment

To use the present invention, a picture holding frame element designed to be laced within a shoe upper or otherwise attached to an article of apparel. A user then places a visual image within the display housing to proudly show pictures of loved ones or other objects in a manner which is not only quick, easy and effective, but unique as well.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

What is claimed is:

1. An apparel mounted picture securing and displaying apparatus comprising:

a lower support member formed of a generally planar surface having a rectangular outer perimeter and having a pair of lateral sides intersecting a pair of horizontal sides at four corner points;

a corner attachment orifice formed at each said corner point;

an upper frame element forming a transparent retention means within an outer perimeter; and attachment means for attaching said upper frame element to said lower support member.

2. The apparel mounted picture securing and displaying apparatus of claim 1, wherein said lower support member has an upper surface that supports a plurality of loop fastener elements of a hook and loop fastener affixed to an upper surface in a manner that circumscribes the outer perimeter of the lower support member.

3. The apparel mounted picture securing and displaying apparatus of claim 2, wherein a non-transparent border circumscribes the outer perimeter of said transparent retention means.

4. The apparel mounted picture securing and displaying apparatus of claim 2, wherein on a lower surface of a border are hook fastener elements of a hook and loop fastener, wherein said hook fastener elements align with the loop fastener elements such as to allow the transparent retention means to be aligned with and affixed to the lower support member such as to form a display housing for holding, retaining, and displaying visual images through the transparent retention means.

5. The apparel mounted picture securing and displaying apparatus of claim 1, wherein each said corner attachment orifice allows for passage of a shoe lace in such a manner as to allow said lower support member to be laced onto a shoe in a manner covering the tongue of the shoe.

6. The apparel mounted picture securing and displaying apparatus of claim 1, wherein each said corner attachment orifice allows attachment to headwear.

* * * * *